United States Patent [19]

Bussjager

[11] 4,281,522

[45] Aug. 4, 1981

[54] MAKEUP AIR PRECONDITIONER FOR USE WITH AN AIR CONDITIONING UNIT

[75] Inventor: Rudy C. Bussjager, Syracuse, N.Y.

[73] Assignee: Carrier Corporation, Syracuse, N.Y.

[21] Appl. No.: 89,658

[22] Filed: Oct. 30, 1979

[51] Int. Cl.[3] ..... F25D 17/04

[52] U.S. Cl. ..... 62/409; 62/263; 62/DIG. 16; 165/16; 165/30

[58] Field of Search ..... 62/DIG. 16, 409, 326, 62/263; 165/30, 16

[56] References Cited

U.S. PATENT DOCUMENTS

| | | | |
|---|---|---|---|
| 2,338,382 | 1/1944 | Marlow | 165/30 |
| 2,755,072 | 7/1956 | Kreuttner | 165/59 |
| 3,185,209 | 5/1965 | Quick | 165/30 |
| 4,139,052 | 2/1979 | Lackey | 62/DIG. 16 |
| 4,142,575 | 3/1979 | Glancy | 165/16 |

*Primary Examiner*—Ronald C. Capossela

*Attorney, Agent, or Firm*—J. Raymond Curtin; Robert P. Hayter

[57] ABSTRACT

Apparatus and method for preconditioning makeup air supplied to an air conditioning unit. An add-on preconditioning unit having a separate vapor compression refrigeration circuit is disclosed for heating or cooling makeup air supplied to an air conditioning system.

12 Claims, 2 Drawing Figures

MAKEUP AIR PRECONDITIONER FOR USE WITH AN AIR CONDITIONING UNIT

BACKGROUND OF THE INVENTION

1. Field of the Invention

The present invention relates to an air conditioning system. More particularly, the present invention concerns pretreating makeup air being supplied to an air conditioning unit.

2. Description of the Prior Art

In a typical air conditioning system having a vapor compression refrigeration circuit various components such as a compressor, condenser, evaporator and expansion device are arranged to transfer heat energy between a fluid in heat transfer relation with the evaporator and a fluid in heat transfer relation with the condenser. In a heat pump system an outdoor coil and an indoor coil are located such that the compressor through a reversing valve may direct hot gaseous refrigerant to either coil acting as a condenser. The other coil then acts as an evaporator such that, depending upon the position of the reversing valve, heat energy is either rejected or absorbed in both the indoor coil or the outdoor coil. In the heating mode of operation, heat is rejected in the indoor coil acting as a condenser and heat is absorbed at the outdoor coil acting as an evaporator. The reverse is true in the cooling mode of operation wherein the heat is rejected in the outdoor coil acting as a condenser and heat is absorbed in the indoor coil acting as an evaporator.

It is known in the air conditioning industry to provide an air conditioning unit which is suitable for being mounted on the roof or by the side or some other location next to an enclosure to be conditioned. This unit is typically divided into an indoor section having an indoor heat exchanger and an outdoor section having an outdoor heat exchanger. An indoor fan is mounted within the indoor section for supplying conditioned air to the enclosure. This indoor fan draws this air both from the enclosure as return air and from ambient air as makeup air. The air entering the indoor section is passed in heat exchange relation with the indoor heat exchanger wherein either the heat is absorbed from the air flowing therethrough or heat is rejected to said air. Consequently, the air being supplied to the enclosure is conditioned within the indoor section of the air conditioning unit.

The outdoor section of the unit is arranged such that heat energy may be transferred between the outdoor heat exchanger and the ambient air flowing therethrough. Typically, an outdoor fan is provided to circulate the air through the outdoor heat exchanger. The compressors of the typical system are located within the outdoor section.

Under some operating conditions a relatively high amount of makeup air is required. Particularly in fast food operations having a large grease utilization within the enclosure makeup air may amount to as much as 50% of the supply air to the enclosure. With a high percentage of makeup air required and when the ambient conditions are extreme, it has been found helpful to precondition the makeup air. Makeup air is preconditioned to achieve several effects. Firstly, the capacity of the air conditioning unit (not including preconditioning unit) may be decreased if the makeup air being supplied thereto is preconditioned to either raise or lower its temperature. This sizing decrease may result in a cost reduction in the manufacture of the unit. Additionally, by preconditioning makeup air the air conditioning unit whether in the cooling mode or the heating mode is more efficient since the makeup air has already had its temperature raised or lowered depending upon the appropriate conditions. Consequently, by preconditioning makeup air there may not only be initial savings in manufacturing costs but by an increase in efficiency there may be additional savings in the operating cost of the air conditioning unit.

Additionally, depending upon the various controls, it may be possible under some ambient conditions to provide complete conditioning of the air with the preconditioning unit. As described herein, the preconditioning unit will have a separate heat pump system for transferring heat energy between the makeup air and the ambient. Under certain conditions this makeup air heat pump may be sufficient to handle the load on the system.

SUMMARY OF THE INVENTION

It is an object of the present invention to provide an air conditioning system which receives both return air and makeup air.

It is a further object of the present invention to provide an add-on preconditioning unit for raising or lowering the temperature of makeup air supplied to the air conditioning unit.

It is another object of the present invention to provide a safe, economical and reliable add-on unit capable of increasing the energy efficiency of an air conditioning unit.

These and other objects of the present invention are achieved with the addition of the preconditioning unit to an air conditioning system. The preconditioning unit is mounted such that makeup air flows through a makeup air flow path into the indoor section of the air conditioning unit wherein it is treated and discharged to the enclosure. The preconditioning unit has a partition dividing the unit into a makeup air section and an ambient section. The flow of makeup air into the makeup air section is regulated by a damper arrangement, said flow passing first through the dampers and then through the makeup air heat exchanger prior to be conducted into the indoor section of the air conditioning system. The ambient heat exchanger and compressor are connected to the makeup air heat exchanger to form a refrigeration circuit such that heat energy may be transferred between the makeup air and the ambient air.

DESCRIPTION OF THE PREFERRED EMBODIMENT

The invention as described herein will refer to a rooftop type air conditioning unit adapted to receive return air from the bottom of the unit and to likewise discharge supply air through the bottom of the unit. This invention finds like applicability in all types of air conditioning systems which require makeup air. Additionally, this invention would also apply to other types of refrigeration systems wherein preconditioning the air might be effective to increase the overall performance of the system. Although the present preconditioning unit is described having a separate vapor compression refrigeration circuit utilizing a heat pump it is to be understood that the preconditioning unit might have a nonreversible refrigeration circuit or might have alternate heating means located in the makeup air flow path.

Figure 1:
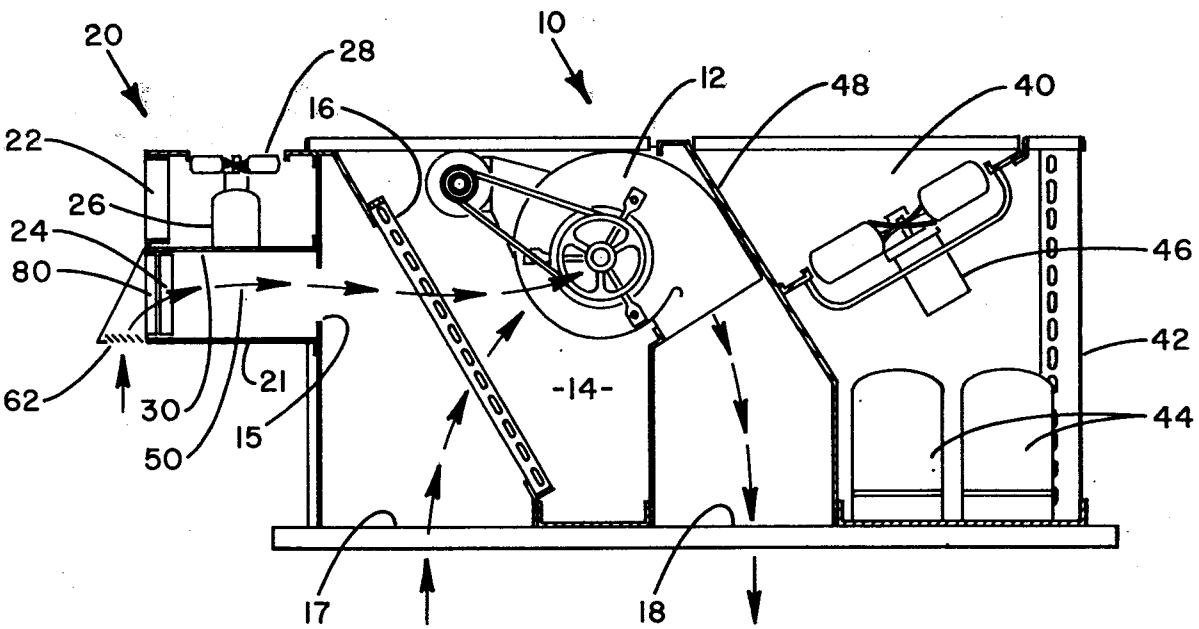
FIG. 1 is a schematic view of a rooftop type air conditioning unit having an add-on preconditioning unit.

Referring now to FIG. 1 there can be seen a rooftop type air conditioning unit 10. The unit is divided by divider 48 into an indoor section 14 and an outdoor section 40. Within the outdoor section are mounted outdoor heat exchanger 42, compressors 44 and outdoor fan 46. The outdoor fan serves to circulate ambient through the outdoor heat exchanger 42 to effect heat exchange therebetween. Indoor section 14 has indoor heat exchanger 16 and indoor fan 12 mounted therein. Return air opening 17 is provided at the bottom of the indoor section as is supply air opening 18. Indoor fan 12 acts to draw air through indoor heat exchanger 16 and discharge same downwardly through the supply air opening 18 into the enclosure to be conditioned.

Preconditioning unit 20 is shown mounted to the end of the air conditioning unit such that makeup air flow path 50 is located in registration with makeup air opening 15 of the indoor section of the air conditioning unit. The preconditioning unit has casing 21 forming an enclosure, said enclosure being divided by partition 30 into an ambient air section and a makeup air section. Dampers 62 regulate the flow of makeup air into the makeup air flow path. Makeup air heat exchanger 24 is located in the makeup air flow path and heaters 80 are located between dampers 62 and heat exchanger 24. Ambient heat exchanger 22 and compressor 26 as well as fan 28 are all located within the ambient section 60 of the preconditioning unit.

Figure 2:
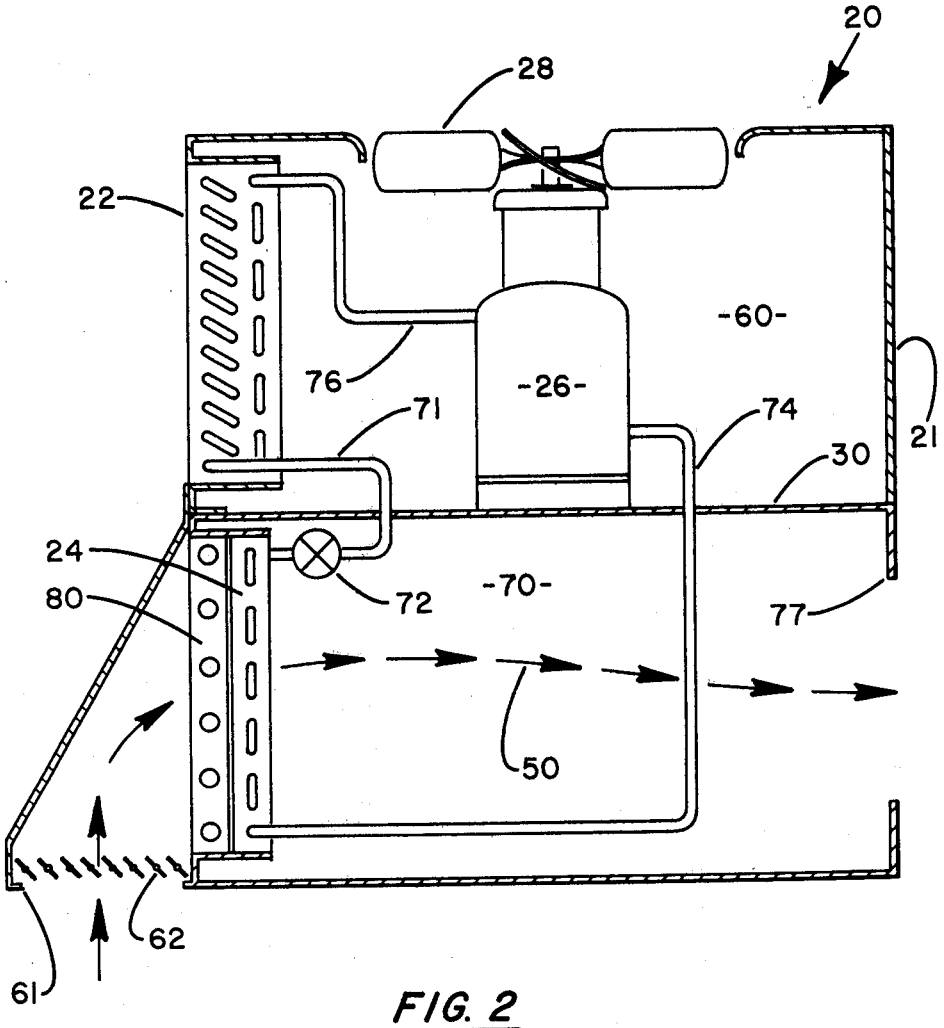
FIG. 2 is a schematic view of the preconditioning unit to be added on to an air conditioning system.

FIG. 2 is an enlarged schematic view of preconditioning unit 20 and more clearly indicates the relation of damper 62, heaters 80 and makeup air heat exchanger 24. It can be further seen in FIG. 2 that compressor 26 is connected by conduit 76 to ambient heat exchanger 22. Ambient heat exchanger 22 is connected by conduit 71 to expansion device 72 which is connected to makeup air heat exchanger 24. Conduit 74 then connects makeup air heat exchanger 24 to compressor 26. This system for illustration purposes only is shown as a straight air conditioning system. Provision of a four-way valve or other means may likewise provide for this refrigeration circuit to be a heat pump circuit capable of supplying heating or cooling to the makeup air heat exchanger 24.

The makeup air flow path can be seen starting at makeup air inlet opening 61 regulated by dampers 62. The makeup air then flows through electric resistance heaters 80, through makeup air heat exchanger 24, through the makeup air section 70 to makeup air discharge outlet 77 which is in registration with the makeup air opening 15 of the indoor section of the air conditioning unit.

Electric heaters 80 may be energized to supply heat for defrosting ice accumulation on the ambient air heat exchanger as well as heating the makeup air. If the makeup air heat exchanger is used as the condenser of a heat pump to reject heat to the makeup air ice may under appropriate ambient conditions form on the ambient air heat exchanger. Defrost of the ambient air heat exchanger is provided by reversing the refrigeration circuit such that the makeup air heat exchanger absorbs heat energy. By providing the electric resistance heaters the energy absorbed may come from the heaters and the makeup air may additionally be heated. Without the heaters heat energy would be absorbed from the makeup air such that the temperature of the makeup air would be lowered when it is desirable to raise the temperature of the makeup air.

OPERATION

Under design operating conditions without a preconditioning unit the air conditioning system would have to be of sufficient size to meet both the heating and cooling loads. By providing a preconditioning unit it is possible to reduce the overall heating and cooling capacity of the air conditioning unit since the makeup air being supplied thereto has been preconditioned.

When the enclosure or space has a cooling or heating demand the air conditioning system is operated to supply treated air to the space. When ambient conditions are appropriate, the makeup air being supplied through the preconditioning unit is heated or cooled by makeup air heat exchanger 24. Typically, on a very cold or very hot day the entering temperature of the makeup air may be raised or lowered such that the overall temperature condition of the combination of return air and makeup air entering the indoor heat exchanger is raised or lowered such that the refrigeration circuit of the air conditioning unit is operating in a much more efficient range.

Either the refrigeration circuit of the air conditioning unit which may be a straight air conditioning system or a heat pump is operated alone, the preconditioning unit is operated alone or both systems are operated simultaneously. The provision of two separate systems provides the added flexibility of operating the systems independently or together and the cost reduction of being able to size the units based on the combined operation. Additionally, the provision of a combined operation allows for more efficient performance of the units. The operation of the preconditioning unit solely may additionally save energy under some load conditions.

While the invention has been described in reference to a preferred embodiment it is to be understood by those skilled in the art that modifications and variations can be effected within the spirit and scope of the invention. It is further to be understood that although the preferred embodiment is described having a straight air conditioning system in combination with a heat pump it is within the spirit and scope of the invention to utilize any type of refrigeration circuit in either the air conditioning unit or the preconditioning unit.

I claim:

1. An air conditioning system which comprises:

an enclosure defining an indoor air section;

a first refrigeration circuit including an indoor heat exchanger mounted within the indoor air section in heat exchange relation with air flowing therethrough and a second heat exchanger located remotely from the indoor heat exchanger to transfer heat energy between the indoor heat exchanger and the second heat exchanger;

an indoor fan for circulating air in heat exchange relationship with the indoor heat exchanger and for circulating air to a space to be conditioned;

a return air flow path for supplying return air from the space to the indoor section;

a makeup air flow path for allowing ambient air to enter the indoor section;

damper means for regulating the volume of air flowing along the makeup air flow path; and a second vapor compression refrigeration circuit including a makeup air heat exchanger located in heat exchange relation with the air flowing along the makeup air flow path, an outdoor heat exchanger in heat exchange relationship with an ambient heat sink and a compressor for increasing the temperature and pressure of a refrigerant flowing within the second refrigeration circuit whereby heat energy is transferred between the makeup air heat exchanger and the outdoor heat exchanger.

2. The apparatus as set forth in claim 1 wherein the first refrigeration circuit and the second refrigeration circuit are both reversible refrigeration circuits capable of transferring heat energy to the indoor air or the makeup air and capable of absorbing heat energy from the indoor air or from the makeup air.

3. The apparatus as set forth in claim 2 and further including electric resistance heaters mounted in the makeup air flow path upstream of the makeup air heat exchanger, said electric resistance heaters being energized to supply heat to the makeup air heat exchanger for effecting defrost of the makeup air refrigeration circuit under the appropriate ambient conditions.

4. The apparatus as set forth in claim 1 wherein makeup air received from the makeup air flow path and return air received from the return air flow path are mixed in the indoor section prior to flowing through the indoor heat exchanger.

5. The apparatus as set forth in claim 1 wherein the indoor fan draws air into the indoor section from either or both the return air flow path and the makeup air flow path, said air being circulated through the indoor heat exchanger and to the space to be conditioned.

6. The apparatus as set forth in claim 1 and further comprising an outdoor section wherein the second heat exchanger is mounted in heat exchange relationship with ambient air, a compressor mounted in the outdoor section as part of the first refrigeration circuit and an outdoor fan for circulating ambient air in heat exchange relationship with the second heat exchanger.

7. An add-on unit for use with air conditioning apparatus having an indoor section including a heat exchanger for transferring heat energy between air flowing through the indoor section and heat transfer media flowing through the heat exchanger, an indoor fan for creating air pressure differentials to both draw air into the indoor section and discharge air therefrom, a supply air discharge opening through which conditioned air may be discharged from the indoor section, a return air opening through which air from the space being conditioned may be returned to the indoor section and a makeup air opening through which ambient air may enter the indoor section which comprises:

a casing defining a makeup air flow path, said casing being adapted to be mounted in conjunction with the indoor section of the air conditioning apparatus such that the makeup air flow path is in registration with the makeup air opening to the indoor section;

a heat exchanger located within the makeup air flow path of the casing, said heat exchanger being adapted to transfer heat energy between makeup air flowing through the makeup air flow path and the heat transfer media flowing through the heat exchanger;

a partition dividing the casing into a makeup air section having a makeup air flow path and an ambient air section;

an ambient air heat exchanger located in the ambient air section;

a compressor; and interconnecting piping between the makeup air heat exchanger, the ambient heat exchanger and the compressor forming a refrigeration circuit for the transfer of heat energy between the ambient heat exchanger and the makeup air heat exchanger.

8. The apparatus as set forth in claim 7 and further comprising:

means for controlling the flow of makeup air through the makeup air flow path.

9. The apparatus as set forth in claim 7 and further including electric resistance heaters mounted in the makeup air flow path upstream of the makeup air heat exchanger for supplying heat energy to the makeup air heat exchanger for defrost of the ambient heat exchanger while simultaneously heating the makeup air.

10. An air conditioning system mounted exterior of a space to be conditioned for conditioning air to be supplied to the space which comprises:

an indoor section wherein air may be heated or cooled by a reversible refrigeration circuit including an indoor heat exchanger located in heat exchange relation with the air flowing through the indoor section;

means for supplying return air to the indoor section;

means for supplying outdoor air to the indoor section including means to direct outdoor air to the indoor section and to either heat, cool or pass without change said outdoor air as it flows to the indoor section;

said means for supplying outdoor air including a reversible vapor compression refrigeration system for transferring heat energy between the outdoor air being supplied to the indoor section and other outdoor air to selectively effect a temperature change of the outdoor air flowing to the indoor section.

11. The apparatus as set forth in claim 10 and further including damper means for regulating the volume flow of outdoor air to the indoor section.

12. The apparatus as set forth in claim 10 and further including electric resistance heaters mounted in the makeup air flow path upstream of the makeup air heat exchanger, said electric resistance heaters being energized to supply heat to the makeup air heat exchanger for effecting defrost of the makeup air refrigeration circuit under the appropriate ambient conditions.

* * * * *